US006347977B1

(12) United States Patent
Frost

(10) Patent No.: US 6,347,977 B1
(45) Date of Patent: Feb. 19, 2002

(54) METHOD AND SYSTEM FOR CHEMICAL MECHANICAL POLISHING

(75) Inventor: David T. Frost, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/514,416

(22) Filed: Feb. 28, 2000

Related U.S. Application Data

(60) Provisional application No. 60/153,748, filed on Sep. 13, 1999.

(51) Int. Cl.[7] ..... B24B 1/00

(52) U.S. Cl. ..... 451/6; 451/41; 451/182; 451/258; 451/285; 451/287; 451/298

(58) Field of Search ..... 451/41, 6, 182, 451/183, 254, 258, 446, 285, 287, 288, 398

(56) References Cited

U.S. PATENT DOCUMENTS

| | | | | |
|---|---|---|---|---|
| 5,083,401 A | * | 1/1992 | Yamashita et al. | 451/5 |
| 5,097,630 A | * | 3/1992 | Maeda et al. | 451/65 |
| 5,643,044 A | * | 7/1997 | Lund | 451/5 |
| 5,643,056 A | * | 7/1997 | Hirose et al. | 451/41 |
| 5,851,135 A | | 12/1998 | Sandhu et al. | |

FOREIGN PATENT DOCUMENTS

| | | | | |
|---|---|---|---|---|
| EP | 0362 516 | | 4/1990 | |
| EP | 0 362 516 A | * | 11/1990 | ..... B24B/37/04 |
| JP | 57194866 | | 11/1982 | |
| JP | 57-194866 | | 11/1982 | |
| JP | 7-66160 | | 3/1995 | |
| JP | 07066160 | | 3/1995 | |

* cited by examiner

*Primary Examiner*—Joseph J. Hail, III
*Assistant Examiner*—Shantese McDonald
(74) *Attorney, Agent, or Firm*—Martine & Penilla, LLP

(57) ABSTRACT

A system for chemical mechanical polishing, and a method of chemical mechanical polishing and the preparation of wafer surfaces is provided. The preparation can either be a polishing operation or a buffing operation. The chemical mechanical polishing system includes a carrier to hold and rotate a wafer. The wafer has a surface area and is held by the carrier so that the surface area of the wafer to be processed is exposed. The system further includes a roller that has a process surface. The roller is configured to rotate about an axis, and the rotating process surface of the roller is applied with force against the rotating wafer surface defining a contact region on the wafer. The area of the contact region is less than the surface area of the wafer. The contact region is moved between a first region of the wafer and a second region of the wafer during the processing of the wafer, and the force and linear velocity are manipulated to control a rate of removal.

24 Claims, 11 Drawing Sheets

METHOD AND SYSTEM FOR CHEMICAL MECHANICAL POLISHING

CROSS REFERENCE TO RELATED APPLICATIONS

This application claims priority from U.S. Provisional Patent Application No. 60/153,748, filed Sep. 13, 1999, and entitled "Advanced CMP Process and Apparatus."

BACKGROUND OF THE INVENTION

1. Field of the Invention

The present invention relates to chemical mechanical polishing (CMP) systems and techniques for improving the performance of CMP operations.

2. Description of the Related Art

In the fabrication of semiconductor devices, there is a need to perform chemical mechanical polishing (CMP) operations, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization.

FIG. 1A shows a schematic diagram of a chemical mechanical polishing (CMP) process 10, consisting of a CMP system 14, a wafer cleaning system 16, and post-CMP processing 18. After a semiconductor wafer 12 undergoes a CMP operation in the CMP system 14, the semiconductor wafer 12 is cleaned in a wafer cleaning system 16. The semiconductor wafer 12 then proceeds to post-CMP processing 18, where the wafer may undergo one of several different fabrication operations, including additional deposition of layers, sputtering, photolithography, and associated etching.

A CMP system 14 typically includes system components for handling and polishing the surface of the wafer 12. Such components can be, for example, an orbital or rotational polishing pad, or a linear belt polishing pad. The pad itself is typically made of a polyurethane material. In operation, the belt pad is put in motion and then a slurry material is applied and spread over the surface of the belt pad. Once the belt pad having slurry on it is moving at a desired rate, the wafer is lowered onto the surface of the belt pad. Similarly, in rotational or orbital CMP systems, a polishing pad is located on a rotating planar surface, and slurry is introduced. The wafer, mounted on a polishing carrier is lowered onto the surface of the polishing pad. In this manner, the wafer surface that is desired to be planarized is substantially smoothed. The wafer is then sent to be cleaned in the wafer cleaning system 16.

With the increasing necessity for multi-layered complex structures fabricated on larger wafer substrates, more accurate measurement and control of the CMP process is required than provided by current technology. The goal of the CMP process should be to maximize the removal rate and uniformity. As is well known, the removal rate can be determined by Preston's Equation: Removal Rate=KpPV, where the removal rate of material in Angstroms/minute is a function of Downforce (P) and Linear Velocity (V), with Kp being the Preston Coefficient, a constant determined by the chemical composition of the slurry, the process temperature, and the pad surface.

Therefore, one way to increase the removal rate can be to apply the wafer against the polishing pad with increased amounts of pressure (e.g., downforce). However, when the wafer is applied to the pad with excessive force, the wafer can suffer in that stress will be transferred to the brittle wafer which could cause the wafer to break, and excessive force can cause non-uniform removal rates. In addition, a high downforce is limited by stall friction produced by high pressure on the surface of the wafer, and by motor torque, Further, it has been shown that increasing downforce can actually decrease both local and global uniformity.

Another way to increase removal rates and uniformity is to increase the velocity of the polishing pad. The increase in velocity can also be done in conjunction with the application of more pressure. The limiting factors for achieving increased linear velocity include carrier size and mass, the larger physical size of the CMP system and motor torque. For example, some belt-type CMP systems can be quite large, thus requiring more torque and power to move the belt. Consequently, linear velocity in conventional CMP systems cannot be efficiently increased.

If linear velocity were somehow increased, a hydroplaning effect could start to occur between the surface of the wafer and the polishing pad. Hydroplaning is believed to occur due to the increased linear velocity of the wafer and the fact that a film of chemical s (e.g., slurry) cover the polishing pad surface.

To illustrate another problem with conventional CMP systems, reference will now be made to FIGS. 1B–1C. As is well known, present CMP systems are used to remove metallization material, such as copper, to isolate metal lines in an oxide layer. In FIG. 1B, an oxide layer 102 is shown over a substrate 100. Trenches 102*a*–102*d* have been etched in the oxide layer 102 that will be used to create metal lines within the oxide layer 102. Prior to applying the metal layer 104, a thin barrier or liner layer (not shown) is deposited over the entire surface. As is known, materials such as silicon nitride, titanium itride, and the like are used for the barrier. Then, the metal layer 104 is applied over the oxide layer 102 completely filling the illustrated trenches 102*a*–102*d*. In FIG. 1C, conventional CMP has been performed on the metal layer 104 to remove the excess metal, and barrier, and smooth the surface at the oxide layer 102 such that the trenches 102*a*–102*d* stay filled with the remaining metal from the metal layer 104, and running throughout the oxide layer 102 as metal lines.

As shown in FIG. 1C, deformities known as "erosion" and "dishing" occur on the planarized surface at points 106 and 108 respectively. In current technology CMP systems, the entire surface of the wafer is always in contact with and polished by the polishing belt or pad and slurry. Because of the differences in hardness of the oxide, the barrier, and the metal layers, rate of removal changes significantly as the layers are processed and the different layers are exposed. The softer metal layer 104 is removed at a higher rate than both the harder barrier and oxide. Once the metal layer is removed in the oxide regions 106 between the metal lines 104, continued processing can result in the dishing shown in the metal lines at 108. Continued processing, however, is necessary to remove the barrier layer over the oxide. The process known as "over-polishing" is often needed to compensate for variations in thickness, but too much over-polish can result in erosion or localized thinning of the oxide illustrated at points 106. As is well known, dishing and erosion 106 can have a negative impact on the performance of a finished integrated circuit fabricated from the wafer.

In view of the foregoing, there is a need for CMP systems that efficiently allow increases in linear velocity and also allow increased amounts of force to be applied against the wafer without the disadvantages of the prior art. The increases in linear velocity and force should be controlled to achieve increased removal rates and uniformity of the planarized surface of the wafer.

SUMMARY OF THE INVENTION

Broadly speaking, the present invention fills these needs by providing a CMP system that provides increased, uniform, and controllable removal rates. The CMP system allows for significant increases in linear velocity over the prior art without the previously associated detrimental effects of dishing, erosion, and hydroplaning, and can incorporate real-time in-situ monitoring of material removal to provide precise and controllable wafer processing. It should be appreciated that the present invention can be implemented in numerous ways, including as a process, an apparatus, a system, a device or a method. Several inventive embodiments of the present invention are described below.

In one embodiment, a CMP system is disclosed. The CMP system includes a carrier that holds and rotates a wafer. The wafer is held on the carrier so that the surface to be processed is exposed. The system also includes a roller that is covered by a process surface such as a pad or brush as use d in CMP or buffing operations. The roller rotates so that the rotating process surface is applied against the rotating wafer at a roller contact region. The roller contact region has a surface area that is less than the wafer surface area. In addition to rotational movement, the roller also has transverse movement, and as the roller is applied against the wafer surface, the roller also moves across the wafer from one region to another. In this manner, the entire surface area of the wafer is processed.

In another embodiment, a method for chemical mechanical polishing is disclosed. The method includes rotating a carrier that hold s a wafer. The carrier holds the wafer so that the surface of the wafer to be processed is exposed. The method further includes rotating a roller about an axis of rotation. The roller is covered by a process surface such as a pad or brush as used in CMP or buffing operations. The rotating process surface is applied against the rotating wafer surface to define the roller contact region. The area of the roller contact region is less than the area of the wafer surface. The roller contact region is further moved transversely across the surface of the wafer to accomplish the CMP or buffing process.

In yet another embodiment, a method for preparing a surface of a wafer is disclosed. The method includes rotating the wafer and applying a rotating surface onto a portion of the wafer. The rotating surface is then moved between a first region and a second region of the wafer. The method further includes defining a linear velocity at a contact surface of the wafer, and applying a force against the wafer at the contact surface. By manipulating the force and linear velocity at the contact surface, the rate of removal and therefore the process of preparing a surface of a wafer is controlled. The rate of removal can also be monitored by implementing a sensor that provides feedback information regarding the removal rate.

The advantages of the present invention are many and substantial. Most notably, the control and precision of the CMP or buffing processes achieved allows for the fabrication of more complex multi-layered integrated circuits. The ability to increase linear velocity and pressure during processing increases the rate of removal over prior art. Not only does this result in a higher processing throughput, but the processing at a surface contact region of the wafer instead of the prior art continuous, full-surface processing, yields a more controllable and uniform planarized surface.

Another advantage of the present invention is the embodiment that includes a sensor to monitor real-time, in-situ material removal. Prior art necessarily evaluates material removal to manipulate the parameters of processing, but the present invention provides for measurement and evaluation during the processing operation. This ability to manipulate the process as it proceeds and based on the material and environmental conditions of the actual wafer being processed while it is being processed makes the processing more efficient and more precise. The demand for more complex multi-layered integrated circuits requires the ability to precisely and uniformly planarize multi-layered surfaces, and the present invention meets that need.

Finally, a preferred embodiment of the present invention affords a more efficient and more economical use of precious fab floor space. The vertical orientation substantially reduces the system footprint of prior art and enhances overall process control.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

An invention of systems and methods for performing CMP operations on layers of semiconductor wafers is disclosed. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1A:
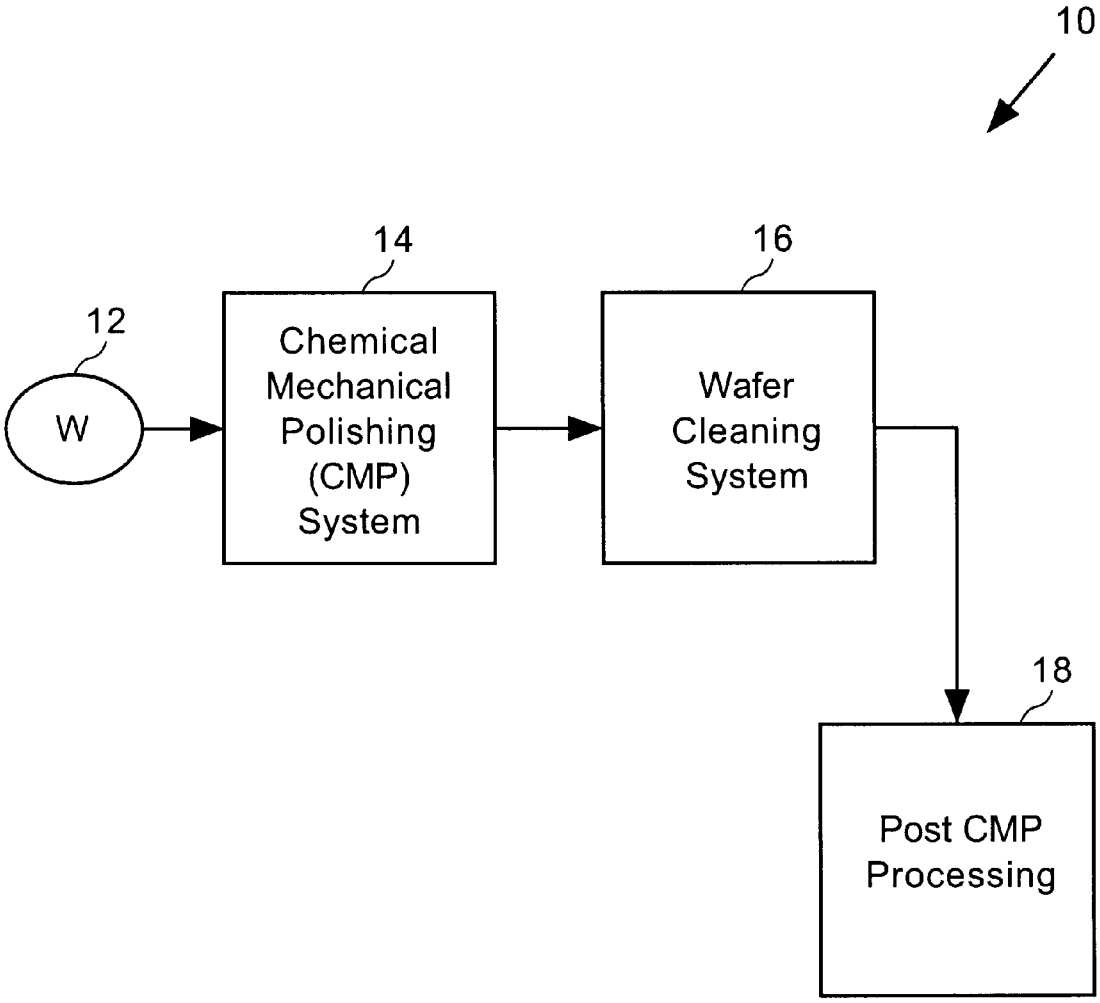
FIG. 1A (prior art)
FIG. 1A shows a schematic diagram of a chemical mechanical polishing (CMP) process, including a CMP system, a wafer cleaning system, and post-CMP processing.
Figure 1B:
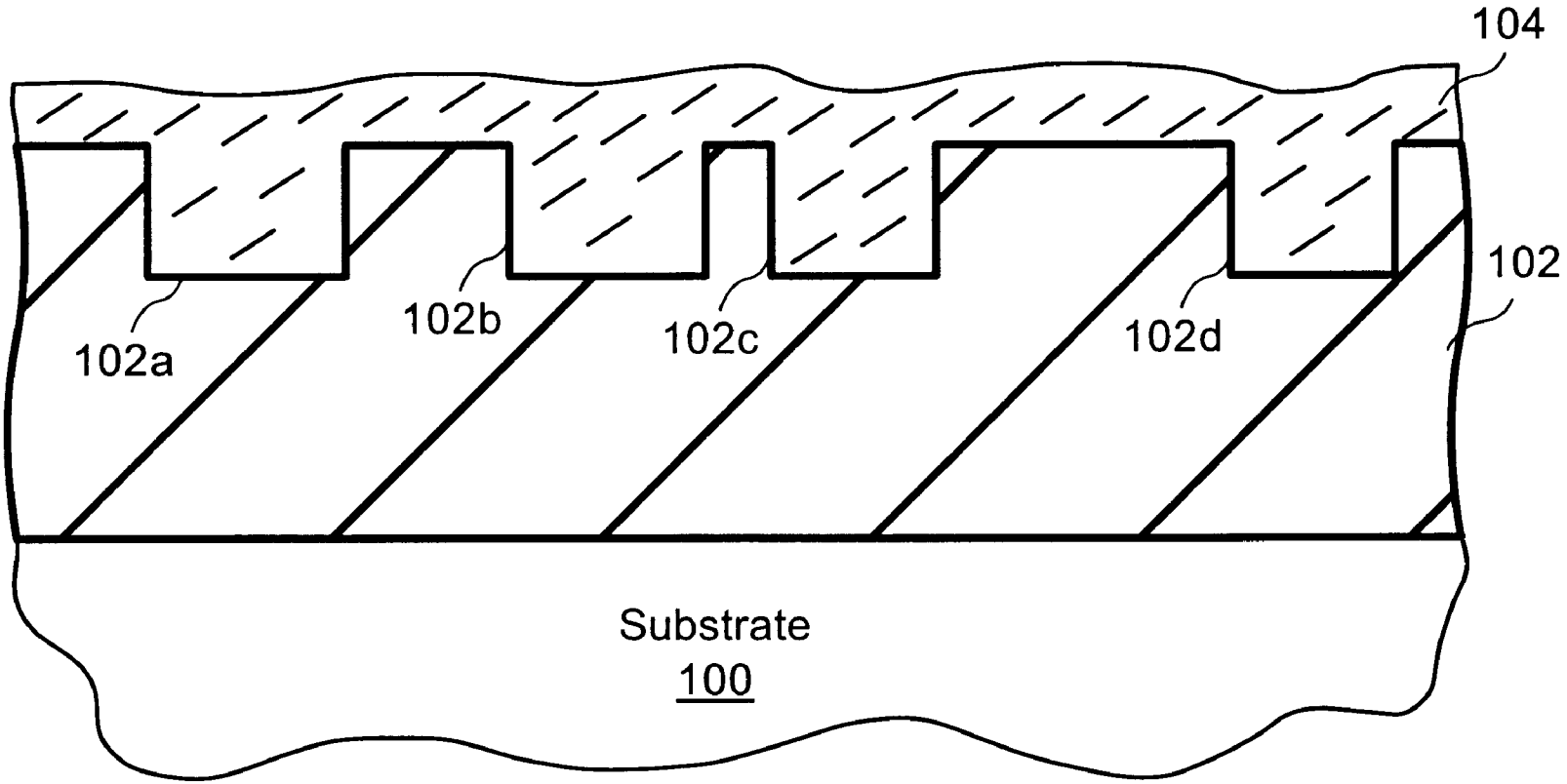
FIG. 1B (prior art)
FIG. 1B shows a typical substrate with a metal layer over an oxide layer.
Figure 1C:
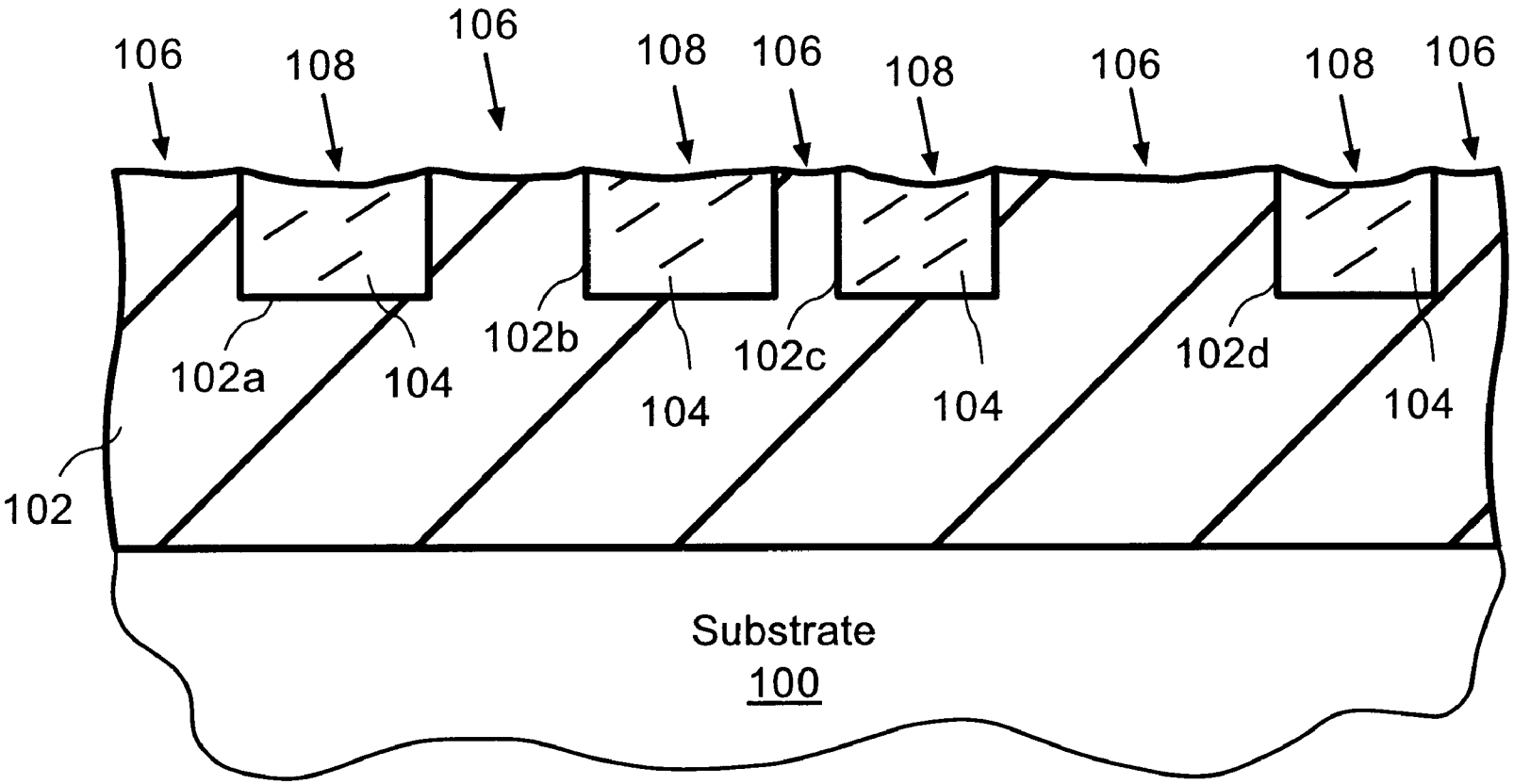
FIG. 1C (prior art)
FIG. 1C shows the same substrate of FIG. 1B after processing using presently available CMP technology.
Figure 2A:
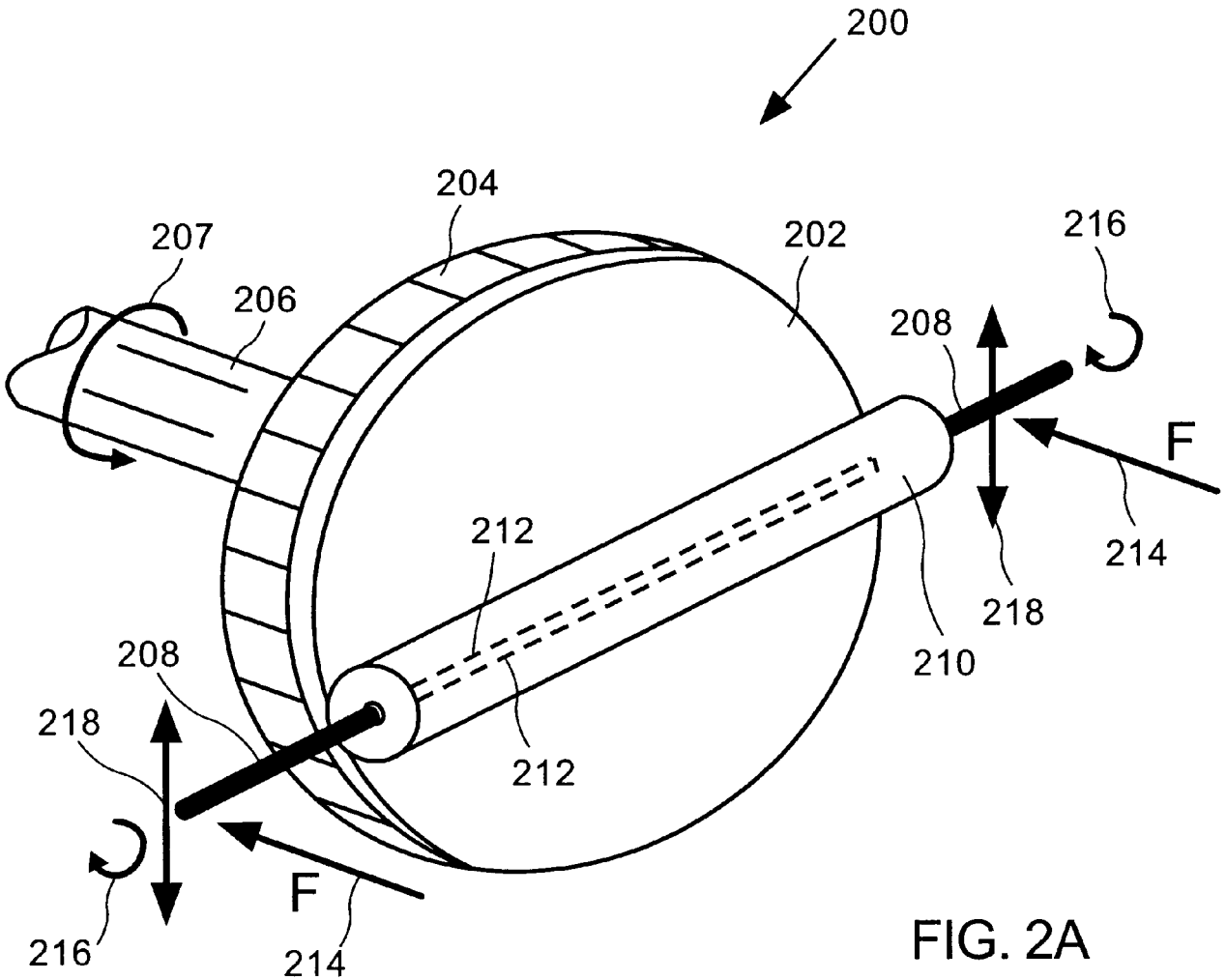
FIG. 2A is a three dimensional view of a CMP apparatus, in accordance with one embodiment of the present invention.

FIG. 2A is a three dimensional view of a CMP apparatus 200, in accordance with one embodiment of the present invention. The CMP apparatus 200 shows a carrier 204 holding a wafer 202 such that a wafer surface area 202' is exposed for processing. The wafer 202 is preferably secured to the carrier 204 using known technology that ensures that the wafer 202 remains attached during processing and substantially prevents the wafer from rotationally moving with respect to the carrier. A drive shaft 206 is connected to a backside of the carrier 204 which is configured to provide a rotation component 207 to the carrier 204 and therefore cause a rotation of the wafer 202 about a wafer axis of rotation 205.

Figure 3:
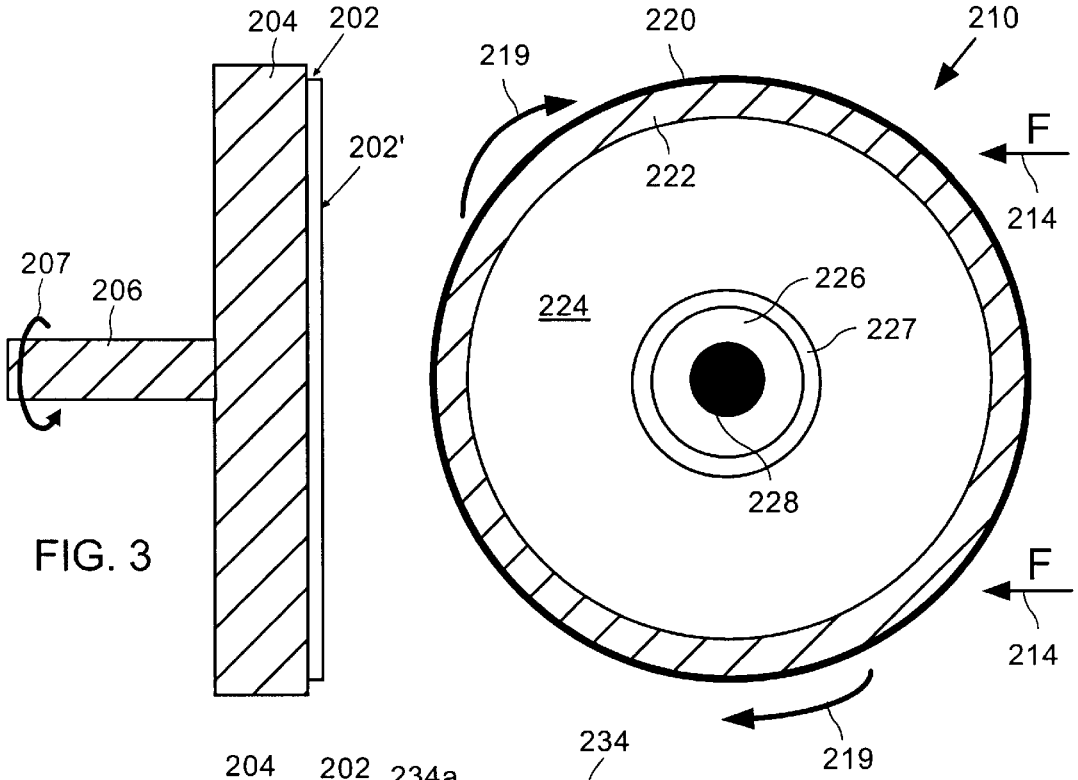
FIG. 3 shows a cross-section view of the CMP apparatus in accordance with one embodiment of the present invention.

A roller 210 is shown configured on a shaft 208. The shaft 208 defines a rotational axis 215 of the roller about which a rotation component 216 is applied. The rotational axis 215 of the roller is substantially normal to the rotational axis of the wafer 205. Although not shown, the shaft 208 can be made to rotate and exert a desired amount of torque using conventional gears and motor technology. In this embodiment, the roller 210 has a process surface 220 (as shown in FIG. 3) which can be a pad, a brush, or any other suitable material that will work for a desired CMP operation, buffing or cleaning. A force 214 is applied to the shaft 208 such that the process surface 220 of the roller 210 is applied against the wafer 202. The roller 210 will therefore only contact the wafer 202 at the surface area defined between contact surface outlines 212. It should be noted that by using a roller 210, the same portion of the wafer 202 is not in continuous contact with the process surface 220 of the roller 210. This is significantly different than prior art CMP implementations that would place the entire surface of the wafer 202 in continuous contact with the polishing surface of a pad or belt.

As depicted, the CMP apparatus 200 is oriented with the wafer 202 in a vertical position. This is one embodiment to maximize the efficient use of space in a fab, but the apparatus 200 could easily be configured to a horizontal or other orientation depending on requirements and available resources.

The rotating roller 210 applied against the rotating wafer 202 produces a linear velocity at the surface of the wafer 202 between the contact surface outlines 212. In one embodiment, the linear velocity at the surface of the wafer 202 (e.g., linear velocity as used herein is defined where the roller 210 meets the surface of the wafer 202) can be increased by increasing the diameter of the roller 210.

Figure 2B:
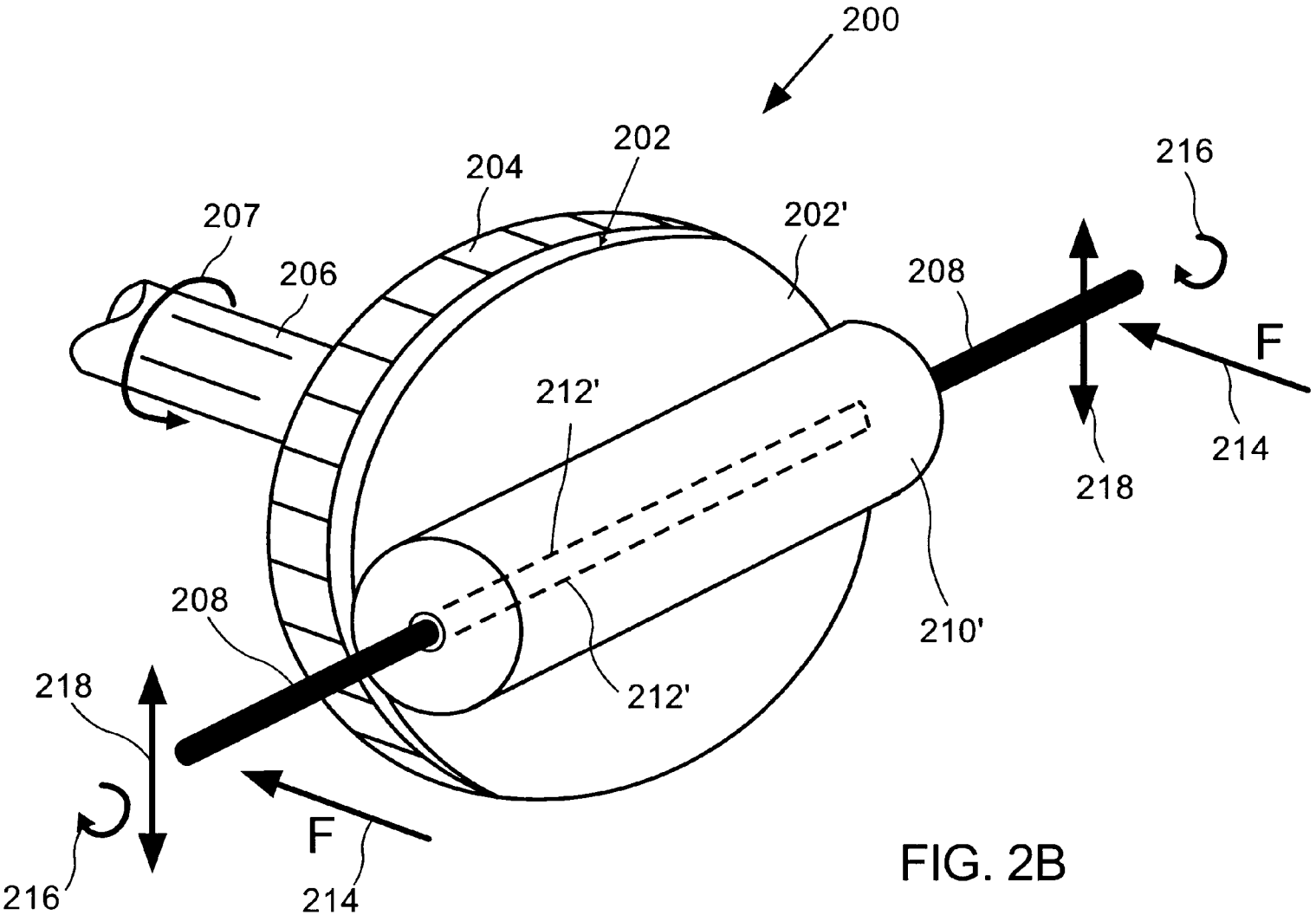
FIG. 2B shows another three dimensional view of a CMP apparatus with a roller having a larger diameter than the roller in FIG. 2A.

FIG. 2B shows a roller 210' with a larger diameter than the roller 210 of FIG. 2A. As mentioned above, the increased diameter of the roller 210' in FIG. 2B creates an increased velocity of the roller process surface 220, which produces an increase in linear velocity on the surface of the wafer 202 between contact surface outlines 212'. Incidentally, a larger roller 210' will also produce a larger foot print on the surface of the wafer 202, which is illustrated by the increase in the separation between the contact surface outlines 212'.

It is understood that the terms CMP operation and CMP process as used herein are general terms that include any number of processes accomplished by a buffing or polishing action using a CMP apparatus. Buffing is generally understood by one skilled in the art to encompass those operations that yield a material removal rate of up to 500 Angstroms/minute, and in some applications, up to 1000 Angstroms/minute. The process generally proceeds to the operation of polishing with the introduction of a chemical compound such as slurry (or any other chemical compound suitable for buffing or polishing) and, using the same mechanical processes described with reference to FIGS. 2A–2B, and with higher linear velocities and increased force, removal rates of up to 4000 angstroms/minute and higher can be achieved.

Figure 2C:
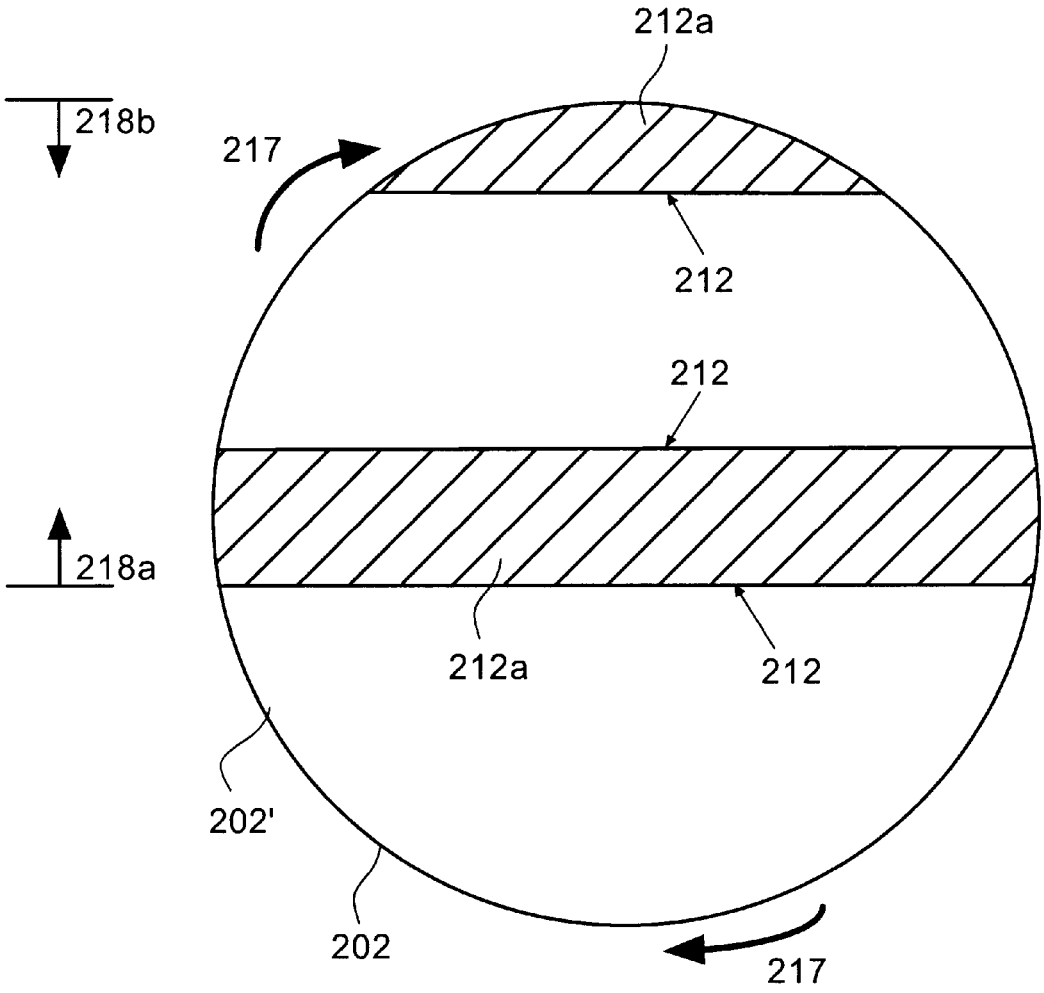
FIG. 2C is a cross-section view of a wafer surface area to be processed with two possible contact regions shown.

As mentioned above, the rate of removal is a function of force, linear velocity, and the Preston coefficient. Therefore, increasing the force and/or the linear velocity will increase the rate of removal. The embodiments illustrated in FIGS. 2A and 2B show that force can be increased without the current technology risks to a wafer since the wafer is mounted on a solid surface and is not susceptible to bowing or uneven force distribution due to back pressure profiles. The illustrated embodiments also demonstrate the ability to easily increase the linear velocity between the contact surface outlines 212/212'. FIGS. 2A and 2B show the roller 210, 210' with the contact surface outlines 212, 212' at a center region of the wafer 202. Also shown is the ability to introduce a transverse movement 218 to the roller 210 and shaft 208. As best illustrated in FIG. 2C, the wafer 202 which is under a rotation 217, has a roller contact region 212*a*. The roller contact region 212*a* is defined between the contact surface outlines 212. The contact surface outlines 212 are shown in both a center region of the wafer and an edge region of the wafer to illustrate that the roller is moved to different positions over the wafer 202. Because the wafer is under rotation 217, the regions 212*a* represent example starting and ending positions of the roller 210 moving in one of a transverse direction 218*a* or a transverse direction 218*b*.

In one embodiment, the roller 210 could be configured to start in the center region of the wafer 202 and travel to the edge of the wafer in the transverse direction 218*a*. Another embodiment could configure the roller 210 to start at the edge region of the wafer and travel to the center region in the transverse direction 218*b*. In any embodiment, however, the wafer rotation 217 causes the entire surface of the wafer to be processed by the process surface 220 of the roller 210, and thus the contact surface outlines 212 do not represent static points on the wafer surface area 202', but regions of contact between the rotating roller 210 and the rotating wafer 202.

FIG. 3 shows a cross-section view of the CMP apparatus 200, in accordance with one embodiment of the present invention. This cross-sectional view illustrates various components of the roller 210. In this embodiment of the present invention, the roller 210 is defined as a tubular structure 222. Preferably, the tubular structure 222 is made of stainless steel or any other material that is rigid enough to enable the application of force against a wafer during a CMP operation. As shown, the roller 210 in the illustrated embodiment is cylindrical, and the tubular structure 222 provides the cylindrical shape with the benefits of strength, rigidity and light weight, however a solid structure can also be used, and other materials for construction may be plastic, rubber or alloy.

Surrounding the tubular structure 222 is the process surface 220. As discussed above, the process surface 220 can be a pad, a brush, or any other material best suited to the requirements of the CMP, buffing, or cleaning process to be accomplished. As is well known, the CMP process is used in a number of applications in semiconductor wafer fabrication, and the process surface 220 can be changed or modified to best suit the requirements. Examples of process surface 220 materials include IC1000 and Porameric. IC1000 and Porameric can be obtained from Rodel of Newark, Del.

A center region 224 of the roller 210 includes the shaft 208 which defines the axis of rotation 215 (e.g., FIG. 2A). The shaft 208 is mounted on a bearing 226 and gimbal 227. As discussed above, force 214 is applied to the shaft 208 during CMP operations. The force 214 is transferred to the roller 210 through the shaft 208, bearing 226, and gimbal 227. The roller 210 has a roller rotation 219 and the process surface 220 is applied against the wafer 202 which also has rotation 217. If the process surface 220 and the wafer surface area 202' are not properly aligned so that the surfaces are flat against each other, uneven processing would occur which would yield an unacceptable result. For this reason, the shaft 208 is mounted on a gimbal 227 to ensure a constant flat alignment between the process surface 220 and the wafer surface area 202' during CMP processing operations.

Figure 4A:
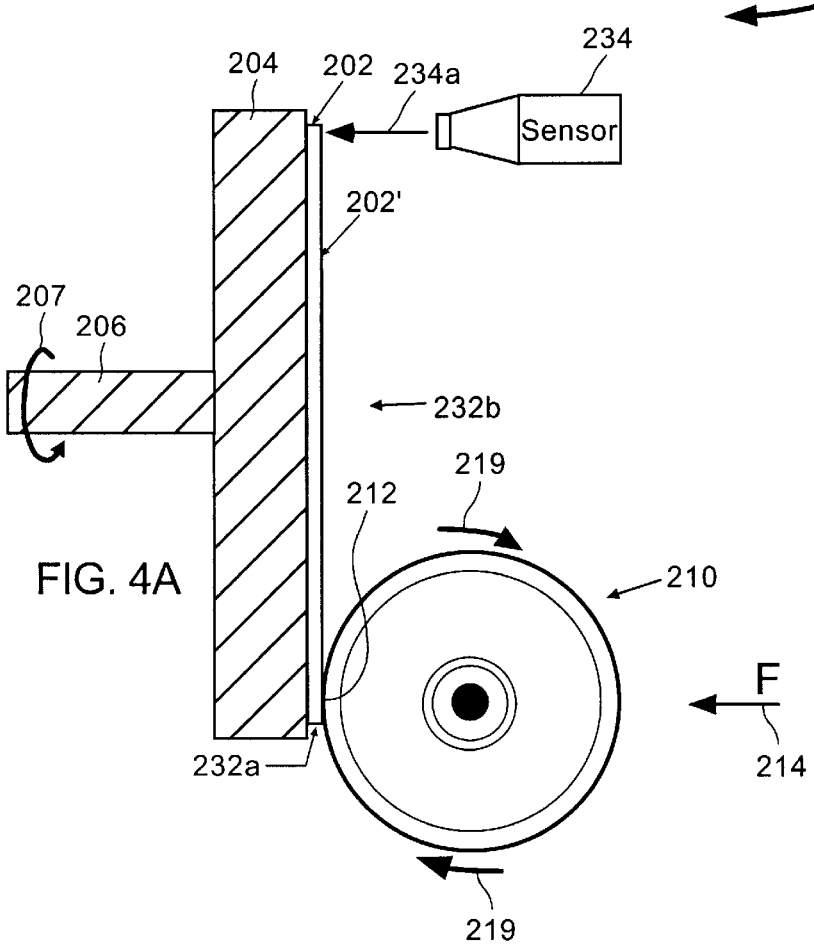
FIGS. 4A–4C illustrate yet another embodiment of the invention that utilizes a sensor to provide in-situ monitoring of material removal during the CMP process.
Figure 4B:
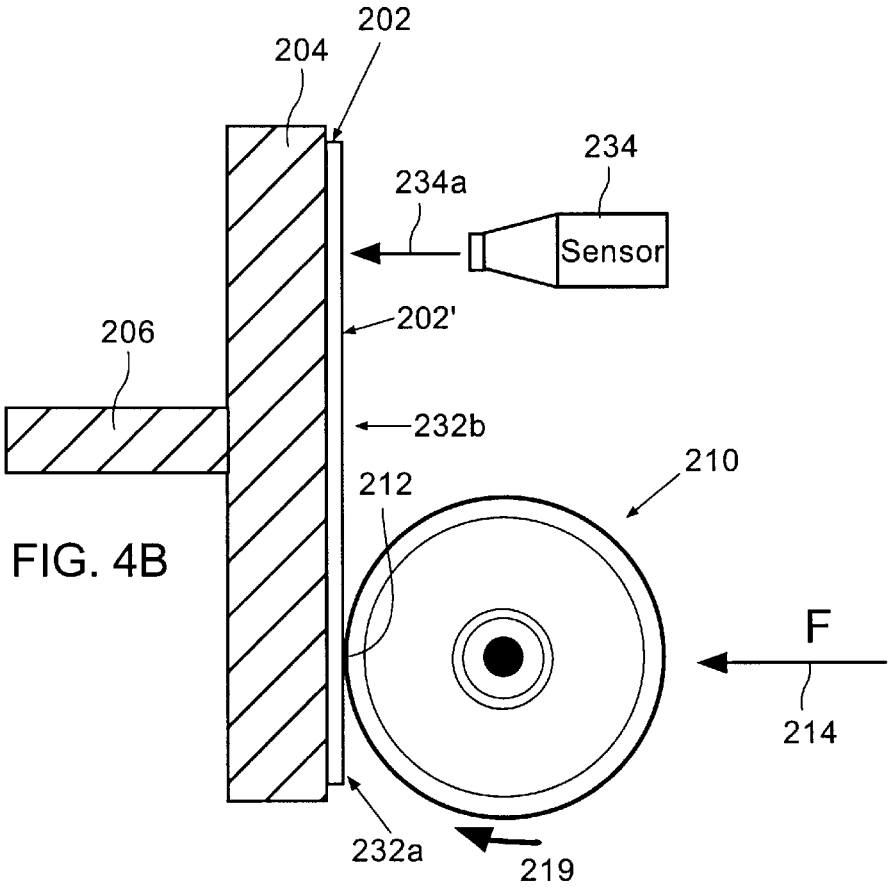
Figure 4C:
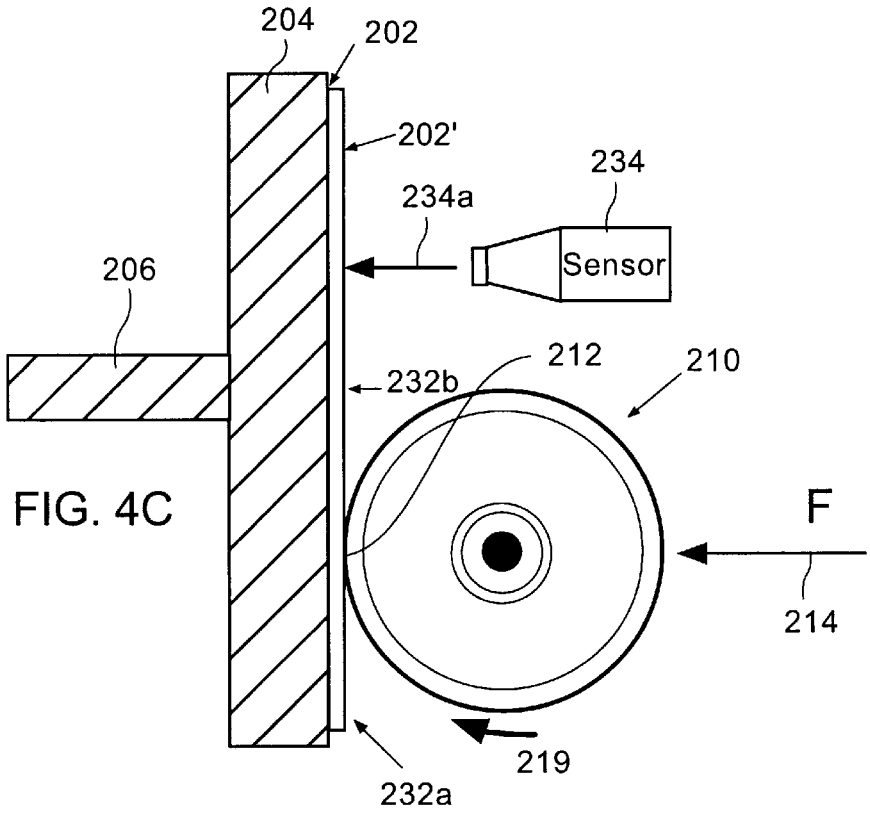

FIGS. 4A–4C illustrate yet another embodiment of the invention that utilizes a sensor 234 to provide in-situ monitoring of material removal during the CMP process. In the prior art, in order to monitor removal rates, it is generally a requirement that the CMP process be stopped in order to accurately measure material removal. Once degree of removal is determined, the CMP process can be restarted, thus imposing a slow down in the processing. The illustrated embodiment demonstrates real-time, in-situ monitor capabilities ensuring precise and uniform material removal while improving processing throughput. In FIG. 4A, the CMP process is started at an outer region 232*a* of the wafer surface area 202'. As discussed above, the present invention can be configured to start CMP processing at a center region 232*b* of the wafer surface area 202' and it can be configured to start the CMP process at an outer region 232*a* of the wafer surface area 202'. The roller 210 which has roller rotation 219 is acted on by force 214 such that the process surface 220 is applied against the wafer surface area 202' which also has rotation 207. The processing begins at the outer region 232*a* at the area of contact defined between the contact surface outlines 212 (as shown in FIGS. 2A–2C). The sensor 234 is configured to monitor the region being processed (here, the outer region 232*a*) through a feedback 234*a* process that utilizes laser, electron, or some other form of measurement and feedback as is known in the field. In one example, the sensor may be a metrology sensor or the like. Still another example of a sensor is a spectroreflectometer, which can be obtained from Nova Measuring Instruments of Israel.

When the sensor 234 determines or predicts the end point of the CMP process, the roller 210 will move from the outer region 232*a* towards the center region 232*b*. In one embodiment, as the process surface 220 moves along the wafer surface area 202', so too will the sensor 234 move from the outer region 232*a* towards the center region 232*b* for continuous, real-time, in-situ monitoring of material removal. In FIG. 4B, it can be seen that the roller 210 is moving from the outer region 232*a* towards the center region 232*b*, and the sensor 234 mirrors the movement. In FIG. 4C, the progressive movement of roller 210 and sensor 234 continues. The sensor 234 provides continuous data including the actual removal rate on a particular wafer surface area 202', the change in removal rate in different regions of the wafer surface area 202', and end point of the CMP process. It is anticipated that this and additional data provided by the sensor 234 will be used by the CMP system to vary the force 214, roller rotation 219, wafer rotation 217, and other parameters to achieve optimum uniform CMP process.

Figure 5:
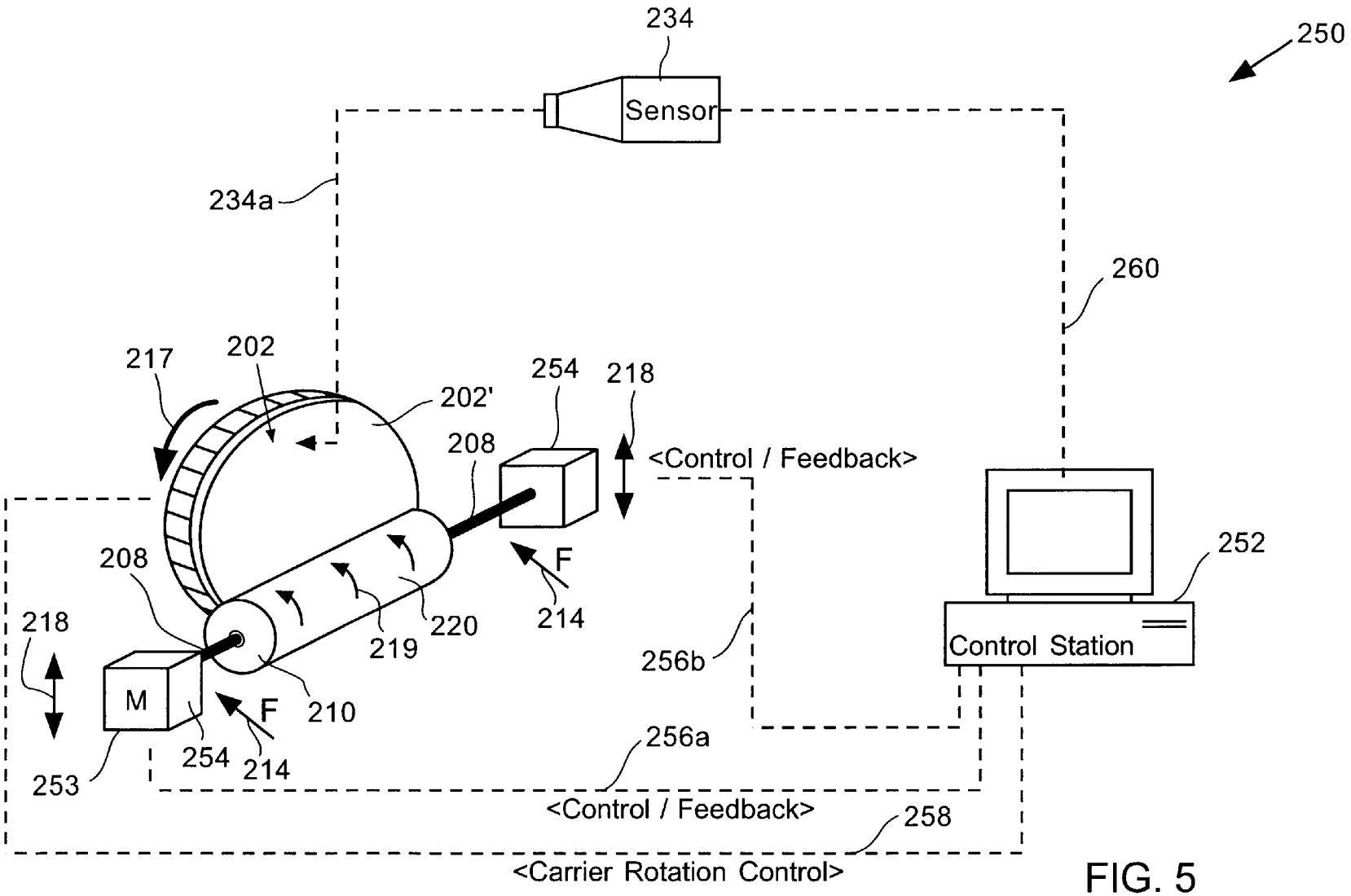
FIG. 5 shows a CMP System Diagram with control and feedback signals, in accordance with one embodiment of the present invention.

FIG. 5 shows a CMP System Diagram 250 with control and feedback signals, in accordance with one embodiment of the present invention. As discussed above, the sensor 234 provides real-time, in-situ monitoring of the CMP process using feedback 234*a*. Data collected by the sensor 234 is communicated to a control station 252 through a sensor response signal 260. In one embodiment, the sensor 234 measures the depth of material on the wafer surface area 202'. The data is sent to the control station 252 via the sensor response 260. In the illustrated example, the control station 252 is a computer workstation to allow for operator input of variables, data evaluation, display, printing, and other workstation functions. In another embodiment, the control station 252 can be a hardware component outputting system commands based on input signals. In yet another embodiment, the sensor response signal 260 is output from the sensor 234 to the control station where it is evaluated with other parameters such as time, temperature, roller rotation 219, wafer rotation 217, and the position of the sensor 234 on the wafer surface area 202'. This information is used to calculate and monitor the rate of material removal on a particular wafer surface area 202', associated linear velocity, force application, and to manipulate system parameters to achieve optimum CMP processing.

The control station 252 uses the data it collects, monitors and evaluates to command roller 210 position and roller rotation 219. As discussed above, the roller 210 is mounted on the shaft 208. The shaft 208 is attached to a motor 253. In one embodiment of the present invention, the motor 253 can be an A/C servo motor to maintain a constant and controllable rate of rotation. The control station 252 continuously monitors the output from the motor 253 via a control/feedback signal 256*a*, and the control station 252 outputs commands to the motor 253 via the control/feedback signal 256*a* to control motor speed and resulting roller rotation 219.

As discussed above, the roller 210 has roller rotation 219 and also has movement in a transverse direction 218. As the wafer 202 is processed, the roller 210 moves along the wafer 202 from the outer region 232*a* to the center region 232*b*, from the center region 232*b* to the outer region 232*a*, or in whichever direction the needs of a particular processing requires (see FIG. 2C). The shaft 208 is mounted on a support structure 254 that enables the movement in the transverse direction 218. Support structure 254 is monitored by the control station 252 via a control/feedback signal 256*b*, and the control station 252 commands the transverse movement 218 of the support structure 254 via the same control/feedback signal 256*b*. In one embodiment of the present invention, the support structure 254 also enables the application of force 214 on the shaft 208 which is transferred to the roller 210 and results in the process surface 220 being applied against the wafer surface area 202'. The control/feedback signal 256*b* is maintained between the support structure 254 and the control station 252 to control the application of force 214.

The embodiment shown in FIG. 5 also shows the variable parameter of wafer rotation 217 as monitored and controlled by the control station 252. A carrier rotation control and feedback signal 258 inputs the carrier rotation to the control station 252, and the control station 252 outputs control signals via the carrier rotation control and feedback signal 258 adjusting the rotation 217. FIG. 5 demonstrates one embodiment of many configurations for the control and feedback of the present invention. It is anticipated that, in addition to the illustrated parameters, the control station 252 will also monitor such variables as temperature and pressure in the processing environment, and achieve optimum CMP processing by real-time measurement and evaluation of processing data and precise control of system variables.

Figure 6:
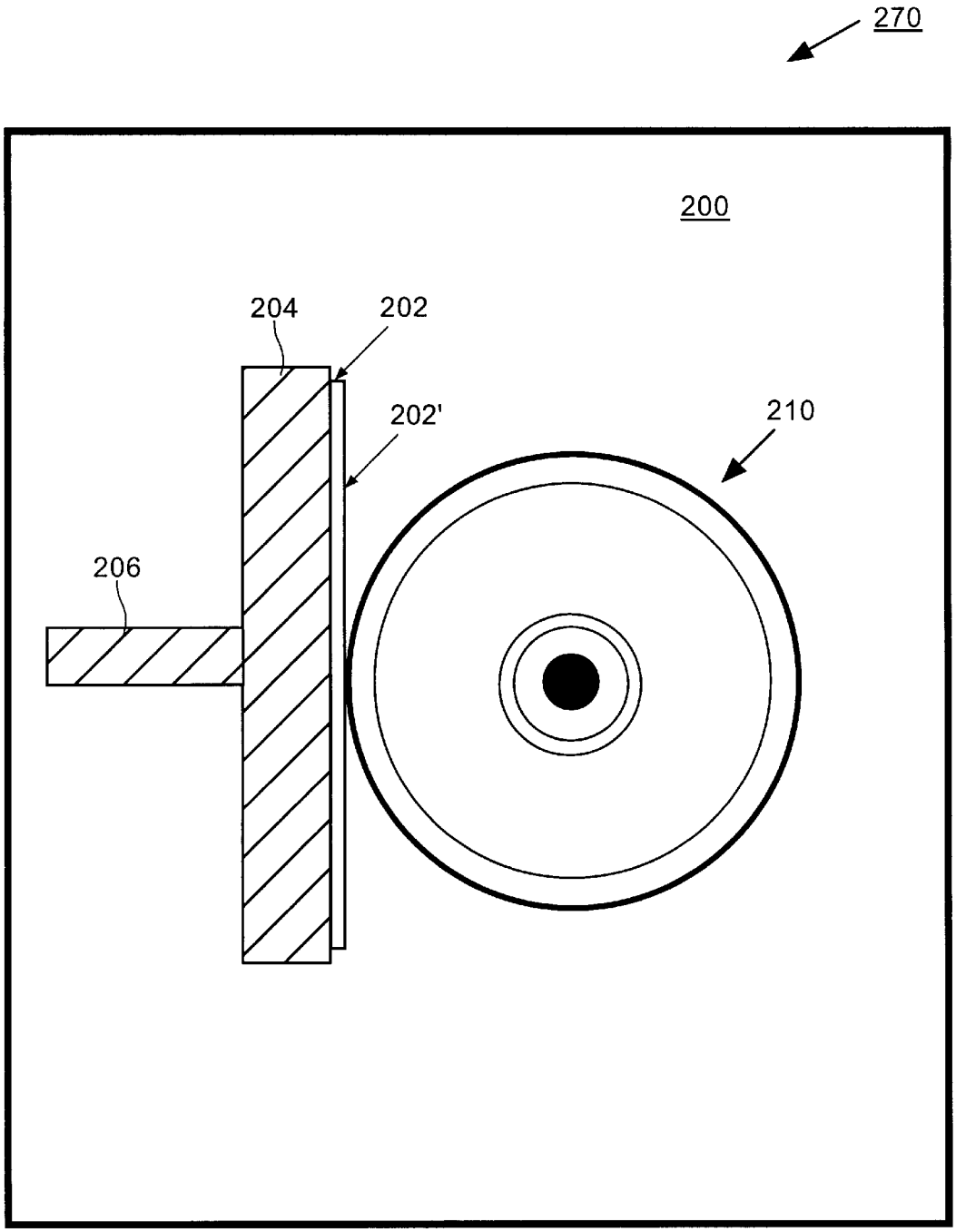
FIG. 6 illustrates the CMP apparatus housed within a CMP process system enclosure.

FIG. 6 illustrates the CMP apparatus 200 housed within a CMP process system enclosure 270. It is anticipated that the CMP process system enclosure 270 would be constructed of steel, alloy, or any other low-particulate-generating material that would provide structure, support, and the ability to introduce processing materials like slurry and chemicals and remove by-products. The CMP process system enclosure 270 is designed to house the CMP apparatus 200, deliver wafers 202 to and from the CMP apparatus 200, maintain the necessary processing environment, and perform any other functions necessary to facilitate safe and efficient CMP processing.

As discussed earlier, a preferred embodiment of the invention is oriented with the wafer 202 and carrier 204 in a vertical position. The CMP process system enclosure 270 provides the structure and support to operate the CMP apparatus 200, and provides the necessary facilities for processing such as electrical power, water, air, and other processing chemicals, gasses, and other materials. Wafers for processing are transported to the CMP process system enclosure 270 and introduced into the processing environment by whatever method is best suited to a particular fab's facilities, processes, and resources. Examples of such methods include end effectors, cassette loaders, robots, and the like. The CMP process system enclosure 270 introduces the necessary materials of processing such as DI water, air, and chemicals, gasses and compounds for slurry, and also transports the by-products of processing out of the processing environment. The CMP process system enclosure 270 also maintains the environmental conditions of the process environment such as temperature and pressure according to the requirements of a particular process. As above, the CMP process system enclosure 270 also enables the transport of the processed wafers out of the processing environment. As is well known, the wafers can be introduced by a side entry point, a top entry point or any other entry point that will facilitate the transfer of wafers in and out, while maintaining low particulate generation. The entry points can be controlled by way of a door or hatch that will enable precision control of the internal environment during processing as described above.

Figure 7:
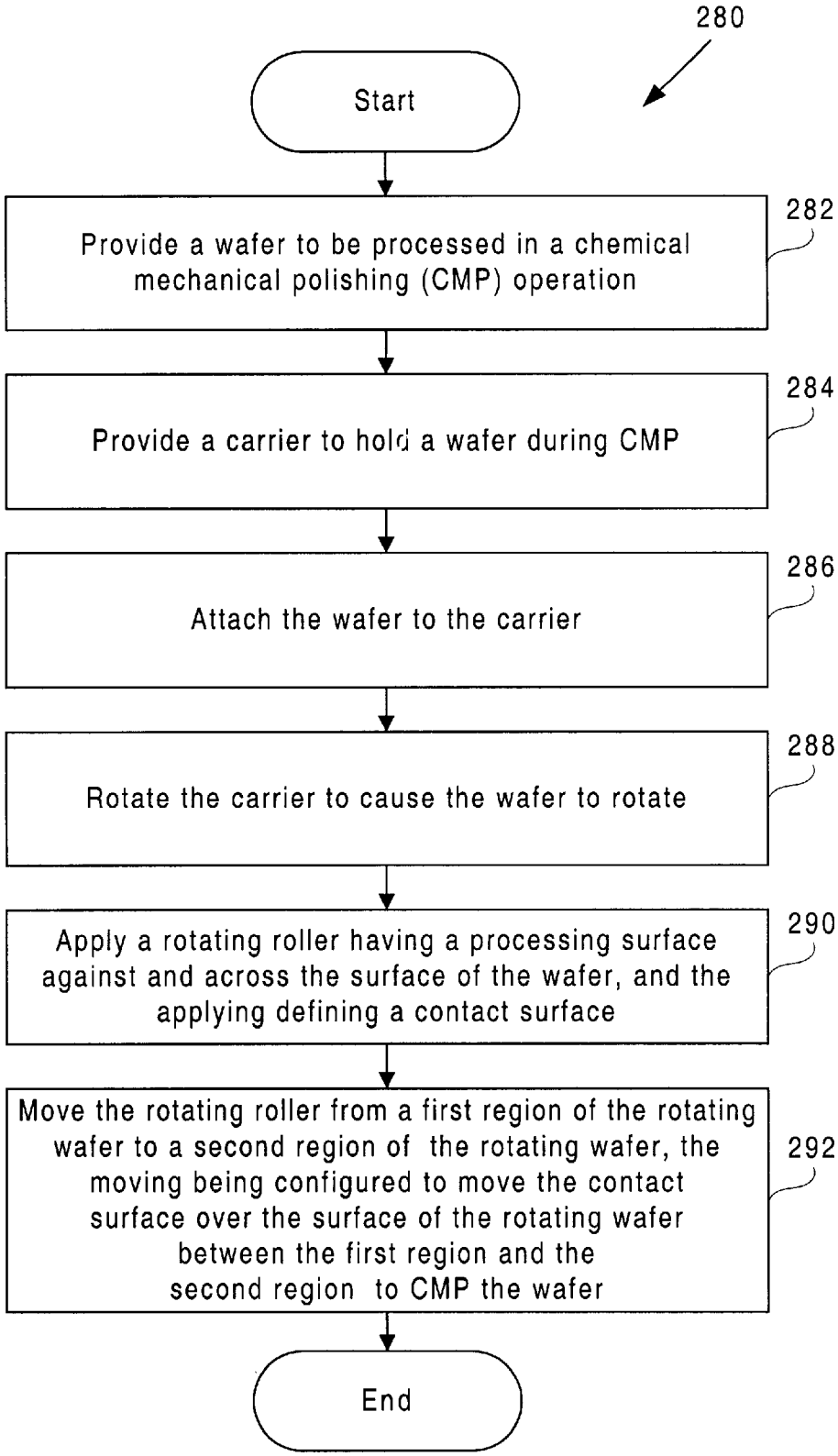
FIG. 7 shows a flowchart diagram defining method operations performed using a CMP apparatus, in accordance with one embodiment of the present invention.

FIG. 7 shows a flowchart diagram 280 defining method operations performed using a CMP apparatus, in accordance with one embodiment of the present invention. The method begins at an operation 282 where a wafer is provided to be processed in a chemical mechanical polishing (CMP) operation. As is well known, wafers are commonly stored in cassettes and transported to different stations during fabrication to complete the desired process operation. Thus, in one embodiment of the present invention, a wafer can be provided from a cassette and handled by an end effector for safe delivery to the CMP apparatus. Once the wafer is provided, the method moves to an operation 284 where a carrier is provided to hold the wafer during CMP operations. The carrier is a part of the CMP apparatus, and in one embodiment, the carrier has a solid surface onto which a wafer is placed. Although any carrier structure that provides rigid support for a wafer can be used, the carrier will preferably approximate the diameter and shape of a silicon wafer used in semiconductor manufacturing or other similar substrates. Further, it is anticipated that the carrier would be constructed of a material of sufficient strength and rigidity to support the application of force against the wafer surface during the CMP process. The carrier should also be of a light-weight material as the carrier is rotated during CMP. Example materials may include hard plastics, aluminum, stainless steel, etc.

Next, the method proceeds to an operation 286 where the wafer is attached to the carrier. The attachment can be accomplished in any manner that would securely hold the wafer in place during the CMP operation. Some examples of attaching the wafer to the carrier include vacuum, electrostatic force, surface tension, or mechanical clamping. Whatever method is employed, the attachment must be of sufficient strength to hold the wafer in place while the carrier is being rotated and under the application of force by a roller. Once the wafer is attached, the method advances to an operation 288 where, as mentioned above, the carrier is rotated. Since the wafer is attached to the carrier, the wafer rotates with the carrier.

A next operation 290 is the application of a rotating roller having a process surface against and across the wafer surface. Operation 290 occurs in a processing environment into which chemicals, or chemical compounds or mixtures, etc., have been introduced to facilitate the polishing, buffing, or cleaning operation. The contact region is defined where the process surface that covers the roller contacts the wafer. In accordance with the method as already described, the wafer is rotating. Therefore, when the process surface is applied against the wafer, it does not define a contact region as a singular, static band or chord across the circular wafer. Accordingly, depending upon the placement of the roller over the wafer, there will be cases where only the outer portions of the wafer are being processed (e.g., the roller is placed over an outer portion of the wafer) and cases in which the entire wafer surface is being processed (e.g., the roller is placed over the center of the wafer), with each rotation of the wafer. In contrast with prior art designs, it should be understood that the process surface of the roller is not actually in contact with the entire surface of the wafer all of the time. That is, the roller is only in contact with a portion of the wafer surface (e.g., contact region) during the time that particular portion of the wafer surface rotates through the rotating process surface of the roller. The exception is when the roller is placed directly over the center of the wafer and some center portion (defined by a small point at the center) is in constant contact with the wafer. The roller is positioned at the center only at the beginning or end of the process depending on whether the roller is moved from the outer region to the center region or from the center region to the outer region.

The method then proceeds to an operation 292 where the rotating roller is moved across the surface of the wafer as illustrated in FIG. 2C. The roller may move from the center region to the outer region, or the roller may move from the outer region to the center region, or the roller may move in any direction across any region of the wafer surface as the requirements of the process dictate. This may be needed when some known topographical variations must be removed. The movement of the roller across the surface of the wafer moves the contact area across the surface of the wafer and progresses from a first region to a second region until the CMP process is completed to the desired result. This is the final operation of the CMP process and when complete, the wafer is removed from the carrier and transported to the next stage of the wafer fabrication process. For example, the next stage following a CMP operation may be a cleaning stage where the residue of CMP is removed and the wafer is prepared for the application of a photoresist layer. Of course, the CMP operation may be repeated several more times for different layers (e.g., oxide, metal, and the like) during the fabrication of wafer into integrated circuits. Once complete, the wafer is cut into dies, each die representing one integrated circuit chip. The chips are then placed into suitable packages and integrated into a desired end device, such as a consumer electronic end product.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. A chemical mechanical polishing system, comprising:

a carrier configured to hold and rotate a wafer in a vertical orientation, the wafer having a wafer surface area; and a roller having a process surface that is configured to rotate as the roller rotates about a roller rotating axis, wherein the process surface of the roller is applied against the wafer at a roller contact region, the roller contact region being less than the wafer surface area.

2. A chemical mechanical polishing system as recited in claim 1, further comprising:

a drive shaft being connected to a backside of the carrier and configured to cause the rotation of the wafer.

3. A chemical mechanical polishing system as recited in claim 1, wherein the roller has a linear velocity component that is governed by a diameter of the roller, the linear velocity component being configured to increase as the diameter of the roller increases.

4. A chemical mechanical polishing system as recited in claim 1, further comprising:

a shaft being defined through the roller and is configured to support the roller when applied against the wafer at the roller contact region.

5. A chemical mechanical polishing system as recited in claim 4, wherein the roller has a gimbal mechanism that is coupled to the drive shaft, the gimbal mechanism is configured to compensate for non-alignments between the wafer and the roller when the roller is applied to the wafer.

6. A chemical mechanical polishing system as recited in claim 1, wherein the roller is applied against the wafer at the roller contact region with a controllable force.

7. A chemical mechanical polishing system as recited in claim 1, wherein the roller is moved in a transverse direction between a first region of the wafer and a second region of the wafer.

8. A method for chemical mechanical polishing, comprising:

rotating a carrier that is configured to hold a wafer in a vertical orientation, the wafer having a wafer surface area;

rotating a roller about an axis of rotation, the roller having a process surface; and applying the process surface of the roller against the wafer on the wafer surface area at a roller contact region, the roller contact region having an area less than the wafer surface area.

9. A method for chemical mechanical polishing as recited in claim 8, wherein the rotating of the wafer is caused by a drive shaft being connected to a backside of the carrier that is rotated by the drive shaft, the holding of the wafer in the vertical orientation is configured to substantially prevent the wafer from rotationally moving with respect to the carrier.

10. A method for chemical mechanical polishing as recited in claim 8, further comprising:

defining a linear velocity component that is governed by a diameter of the roller, the linear velocity component increasing as the diameter of the roller increases.

11. A method for chemical mechanical polishing as recited in claim 8, further comprising:

supporting the roller by a shaft being defined through the roller, wherein the shaft supports the roller when applied against the wafer at the roller contact region.

12. A method for chemical mechanical polishing as recited in claim 11, further comprising:

defining a gimbal in the roller to compensate for non-alignments between the wafer and the roller when the roller is applied to the wafer.

13. A method for chemical mechanical polishing as recited in claim 8, further comprising:

applying a force to the roller and during the applying, the force being a controllable force.

14. A method for chemical mechanical polishing as recited in claim 8, further comprising:

moving the roller in a transverse direction across the wafer surface area, the transverse direction defined from a first region of the wafer to a second region of the wafer.

15. A method for preparing a surface of a wafer, comprising:

rotating the wafer in a vertical orientation;

applying a rotating surface onto a portion of the wafer; and moving the rotating surface between a first region and a second region of the wafer to complete the preparing.

16. A method for preparing a surface of a wafer as recited in claim 15, further comprising:

generating a linear velocity at a contact surface defined on the portion of the wafer, the linear velocity defined by the rotating wafer and the rotating surface; and manipulating the linear velocity to control the preparing of the surface of the wafer.

17. A method for preparing a surface of a wafer as recited in claim 16, further comprising:

defining a force at the contact surface of the wafer, the force being applied by the rotating surface against the contact surface of the wafer; and manipulating the force to control the preparing of the surface of the wafer.

18. A method for preparing a surface of a wafer as recited in claim 17, further comprising:

moving the rotating surface to enable a shift in the contact surface of the wafer in a transverse direction from the first region of the wafer to the second region of the wafer; and manipulating the linear velocity and the force at the contact surface, as the contact surface shifts in a transverse direction, to control the preparing of the surface of the wafer.

19. A method for preparing a surface of a wafer as recited in claim 18, further comprising:

calculating a rate of removal achieved by the preparing of the surface of the wafer; and manipulating the linear velocity and the force at the contact surface, as the contact surface shifts in a transverse direction to control the preparing of the surface of the wafer.

20. A method for preparing a surface of a wafer as recited in claim 15, further comprising:

introducing a chemical compound onto the surface of the wafer during the preparing of the surface of the wafer; and applying the rotating surface against the surface of the wafer at the contact surface with the chemical compound on the surface of the wafer.

21. A method for preparing a surface of a wafer as recited in claim 15, wherein the preparing is one of a CMP operation and a buffing operation.

22. A method for preparing a surface of a wafer as recited in claim 15, wherein the rotating wafer has a wafer axis of rotation, and the rotating surface has a rotating surface axis that is substantially normal to the wafer axis of rotation.

23. A method for preparing a surface of a wafer as recited in claim 15, further comprising:

measuring an amount of a material to be removed in the preparing of the surface of the wafer using a sensor;

locating the sensor over the wafer during the preparing of the surface of the wafer to measure the amount of material to be removed; and using a result from the sensor measurement to calculate a rate of removal.

24. A semiconductor wafer preparation apparatus, comprising:

a carrier configured to hold and rotate the semiconductor wafer in a vertical orientation, the semiconductor wafer having a wafer surface area; and a roller having a process surface that is configured to rotate as the roller rotates about a roller rotating axis, wherein the process surface of the roller is applied against the semiconductor wafer at a roller contact region, the roller contact region being less than the wafer surface area, and wherein the roller has a gimbal mechanism, the gimbal mechanism being configured to compensate for non-alignments between the semiconductor wafer and the roller when the roller is applied against the semiconductor wafer.

* * * * *